United States Patent [19]

Kreutzer

[11] 4,402,542

[45] Sep. 6, 1983

[54] IMPLEMENT FOR CARRYING WHEELS AND TIRES FOR MOTOR VEHICLES

[76] Inventor: Peter Kreutzer, Quellenstrasse 37, A 1100 Vienna, Austria

[21] Appl. No.: 298,156

[22] Filed: Aug. 31, 1981

[30] Foreign Application Priority Data

Jun. 25, 1981 [DE] Fed. Rep. of Germany ..... 2836
Jun. 25, 1981 [AT] Austria ..... 2837

[51] Int. Cl.[3] ..... B65D 63/18
[52] U.S. Cl. ..... 294/156; 294/31.2
[58] Field of Search ..... 294/1 R, 15, 27 R, 27 H, 294/31.2, 137, 138, 148–158, 165, 167, 170, 171; 16/110.5, 114 R

[56] References Cited

U.S. PATENT DOCUMENTS

| | | | |
|---|---|---|---|
| 135,530 | 2/1873 | Dunham | 294/154 |
| 187,716 | 2/1877 | Kirk | 294/154 |
| 504,307 | 8/1893 | Roberts | 294/154 |
| 622,246 | 4/1899 | Matheas | 294/154 X |
| 821,967 | 5/1906 | Strauss | 294/154 |
| 823,258 | 6/1906 | Burton et al. | 294/155 X |
| 988,896 | 4/1911 | Quinn . | |
| 1,730,820 | 10/1929 | Holden . | |
| 2,102,839 | 12/1937 | Dohrman | 294/171 |
| 3,191,830 | 6/1965 | Goetz | 294/156 |

*Primary Examiner*—Johnny D. Cherry
*Attorney, Agent, or Firm*—Fleit, Jacobson & Cohn

[57] ABSTRACT

An implement for carrying wheels and tires for motor vehicles comprises an engaging member (2), which consists of flexible material and is engageable with the tread of the tire so as to extend in the axial direction thereof, and is provided at its edges with lugs (15), to which a handle (1) is connected, which extends transversely to the axial direction of the tire. A retaining belt (3) is also provided, which protrudes from the engaging member (2) as a continuation thereof and is adapted to extend through the central opening of the rim of the wheel. A fastener (4) is secured to the engaging member (2) and to the belt (3) and serves to retain the free end of the retaining belt.

11 Claims, 9 Drawing Figures

FIG. 1
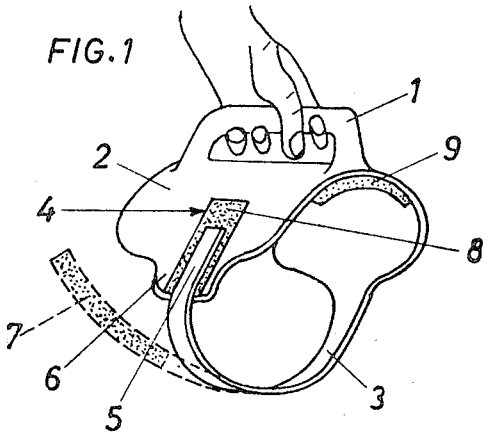
FIG. 2
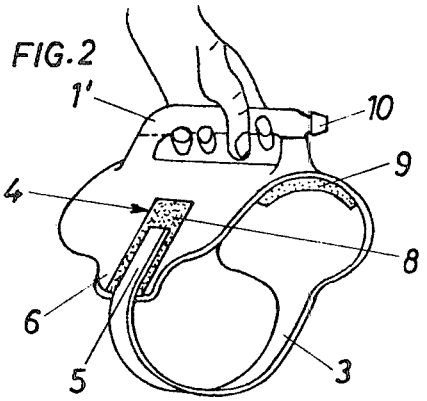
FIG. 3
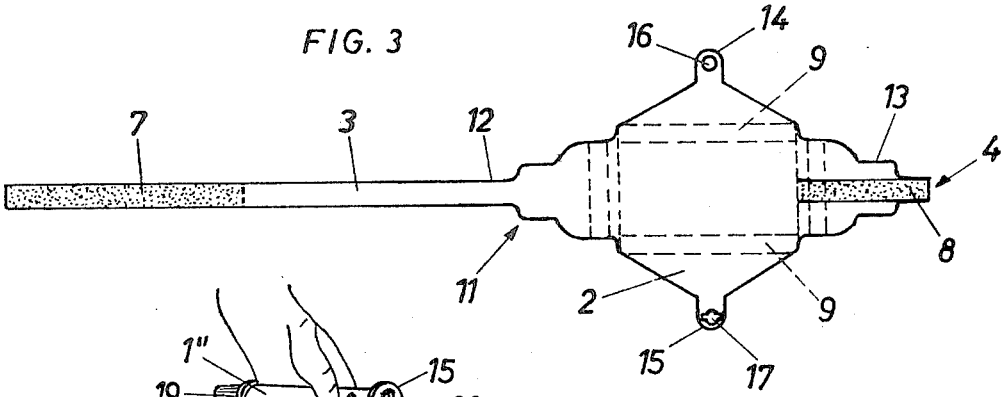
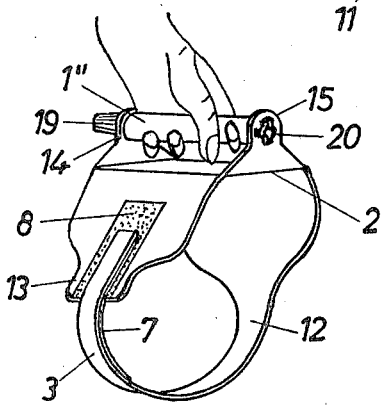
FIG. 4
FIG. 5
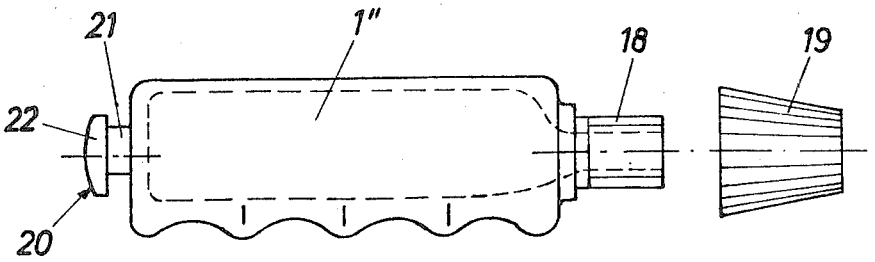

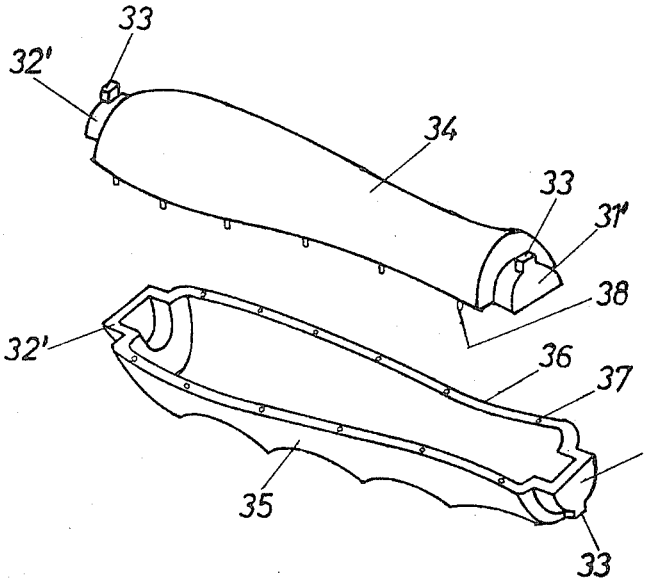
FIG. 7
FIG. 8
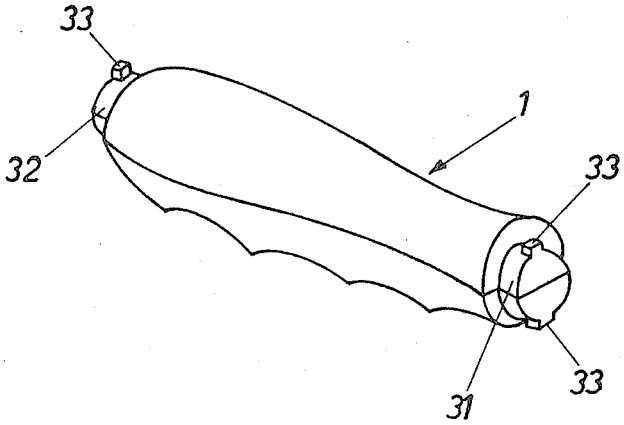
FIG. 9

IMPLEMENT FOR CARRYING WHEELS AND TIRES FOR MOTOR VEHICLES

This invention relates to an implement for carrying wheels and tires for motor vehicles. The implement can be secured in a simple manner to any wheel for a vehicle, such as a motorcycle, a car, or a light truck, as well as to a tire which is to be transported, so that the wheel or tire can be carried in a convenient manner.

Known implements for carrying suitcases, parcels, rolled-up blankets, books and the like comprise a handle, which may be provided with a stiffening baseplate, and a belt or the like, which is connected to the handle and slung around the article to be carried. The handle of said known implements extends in the longitudinal direction of the baseplate or of the article to be held. Such implements cannot be used to carry tires for motor vehicles because it is difficult to secure them to the tire and they do not permit the tire to be carried in a convenient manner.

In order to eliminate that disadvantage the invention proposes an implement which comprises an engaging member that consists of flexible material and is engageable with the tread of the tire so as to extend in the axial direction thereof, a handle, which is connected to the engaging member by means of lugs or the like at the edges of the engaging member and extends transversely to the axial direction of the tire, a retaining belt, which protrudes from the engaging member as a continuation thereof and is adapted to extend through the central opening of the rim of the wheel or the like, and a fastener, which is secured to the engaging member and to the belt and serves to retain the free end of the retaining member, or clips, claws or the like protruding from the engaging member.

Further features of the invention will now be explained with reference to the drawing, in which a plurality of embodiments of the implement are shown by way of example.

FIG. 1 is a perspective view showing a very simple embodiment,

FIG. 2 is a similar view showing a modification,

FIG. 3 is a top plan view showing the main part of another embodiment,

FIG. 4 is a perspective view showing the embodiment of FIG. 3,

FIG. 5 shows a detail on a larger scale and

FIGS. 7 and 8 show two shell sections which together constitute the carrying handle, FIG. 9 shows the carrying handle which is composed of said shell sections.

Figure 6:
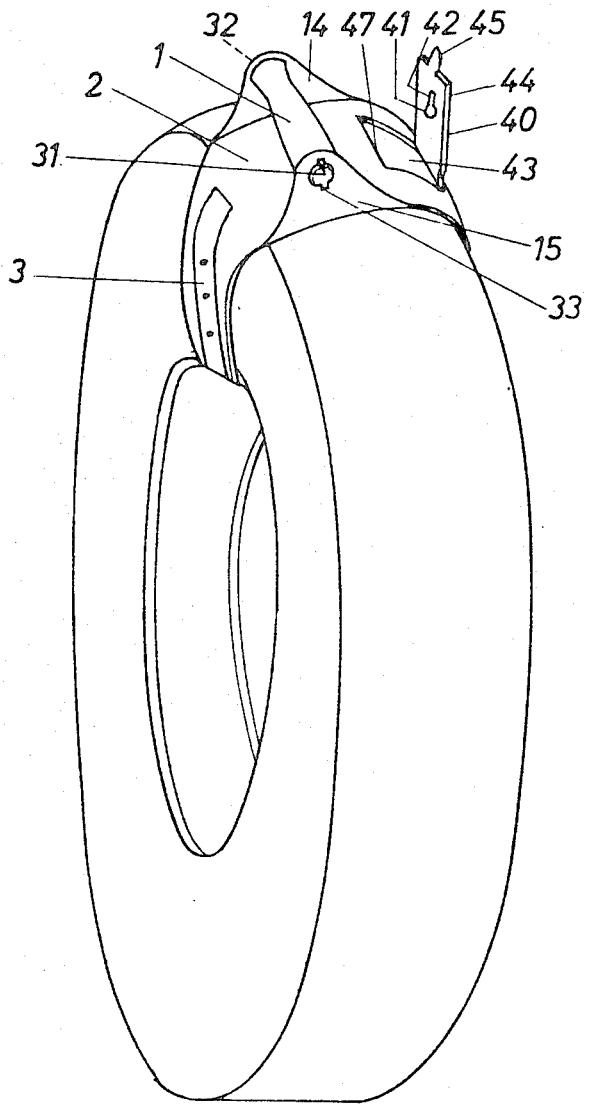
FIG. 6 shows a further embodiment of the carrying implement with a tire held thereby.

The implement shown in FIG. 1 is integral and consists of a carrying handle 1, an engaging member 2, a retaining belt 3 and a fastener 4. All these elements constitute a single piece of a resiliently flexible plastic material, such as polyvinylchloride, higher-molecular polyethylene or the like material of adequate tensile strength and flexibility. This part may be made by injection or compression molding.

The fastener 4 consists preferably of a so-called pile and loop fastener. For this purpose a pile and loop fastener strip 7 is secured to the free end portion 5 of the retaining belt 3 (the strip 7 is indicated in the bent off retaining belt) and a pile and loop fastener strip 8 is secured to the engaging member 2, which for this purpose may be provided with an extension 6. The pile and loop fastener strips 7 and 8 may be secured by adhesive, welding or rivets, for instance.

On that side of the engaging member 2 which faces away from the handle 1, strips 9 of soft elastic material having a high coefficient of friction, such as foam rubber, are secured under each end of the handle, preferably by adhesive.

When it is desired to carry a wheel, the engaging member 2 is applied to the periphery or tread of the tire of the wheel and the retaining belt 3 is passed through one of the holes which are formed in most wheels near the rim thereof. The engaging member 2 is then depressed and the retaining belt is slightly stretched at the same time and in that condition the free end of the retaining belt 3 is joined to the engaging member. In the embodiment shown in FIG. 1 this can be effected in that the two pile and loop fastener strips 7 and 8 are forced one into the other. Because the retaining belt 3 has been stretched and the engaging member 2 has been depressed at the same time, the elastic strips 9 have been compressed to bear firmly on the tread of the tire. As a result, the implement is immovably fixed to the wheel and the latter can be carried conveniently.

To enable the use of the implement for carrying wheels which in their disk have no holes near the rim, the retaining belt 3 may be provided with an extension, not shown, or the retaining belt 3 is so long that it can be pulled through the central hole of the wheel. The extension consists, e.g., of a belt or strip which has the same width and is preferably made of the same material as the retaining belt 3 and carries pile and loop fastener strips on both ends but on different sides, or a fastener of the same kind as that provided on the engaging member and retaining belt Owing to the design of the implement according to the invention the implement can be conveniently secured to wheels of any size, which are formed with holes, to wheels of any kind which have only a central hole, and to tires of different sizes, and can easily be removed.

The embodiment shown in FIG. 2 is similar to that of FIG. 1 and has a hollow handle 1', which is provided at one end with a removable closure cap 10. That cap and the one end of the handle 1' are provided with screw threads like a closure of a squeeze tube. Alternatively, a bayonet joint closure or a snap closure may be provided.

That hollow handle 1' which can be closed may be used to hold a liquid for treating the tire or a liquid for cleaning the hands or another desirable substance. The closure cap may be provided with a sponge or the like for applying the liquid contained in the hollow handle 1'.

An embodiment which differs from those described hereinbefore is shown in FIGS. 3 and 4.

In this embodiment the main part of the carrying implement comprises the engaging member 2 and the retaining belt 3. These two elements constitute an integral piece, which is made as a flat blank 11 from a sheeting of resiliently flexible material, such as polyvinylchloride, polyethylene and the like, in a suitable thickness. That blank 11 comprises a portion which has substantially the configuration of a rhombus or rhomboid, a long extension, which extends from one acute-angled corner of the rhombus or rhomboid and constitutes the retaining belt 3, and a shorter extension 13, which extends from the other acute-angled corner of the rhomboid and carries a fastener. Fixing lugs 14 and 15 protrude from respective obtuse-angled corners of the rhombus or rhomboid and serve to connect the blank 11 to the handle 1'', see FIG. 5. For that purpose one lug, designated 14, and a circular hole 16 and the other lug 15 has a slot 17, which may be widened at the center of its length. The handle 1'', which is shown to a larger scale in FIG. 5, is provided at one end with a screw-threaded extension 18, which fits the circular hole 16 in the fixing lug 14. A nut 19 can be screwed to the screw threaded extension 18. The handle 1'' is provided at the other end with a T-shaped extension 20, which comprises a substantially cylindrical portion 21 and a crosspiece 22. The cylindrical portion 21 and the crosspiece 22 are so dimensioned that the latter can be passed through the slot 17 in the lug 15 and the cylindrical portion 21 can be turned in the slot 17.

As indicated in FIG. 5, the handle 1' may also be hollow. In that case the nut 19 may be constituted by a screw cap. The handle provided with such screw cap may be used to accommodate any of various liquids, as has been described hereinbefore.

When it is desired to prepare the implement shown in FIGS. 3, 4 and 5 for use, the crosspiece 22 of the T-shaped extension 20 is passed through the slot 17 and the handle 1'' is then rotated through 90°. The lug 14 is then bent up and the threw-threaded extension 18 is fitted through the hole 16. Then the nut 19 or the screw cap is screwed onto the screw-threaded extension 18 and is tightened.

This embodiment of the implement is secured to a wheel or tire in the manner described in conjunction with the first embodiment. In the embodiment shown in FIGS. 3, 4 and 5, strips 9 of resilient material may be secured to the underside of the blank 11, as is indicated in FIG. 3.

It will be understood that various changes in design may be adopted within the scope of the invention. For instance it is desirable from the manufacturing aspect to make the engaging member 2 in the form of a flat part in the configuration of a rhombus or rhomboid from resiliently flexible plastic material, such as polyvinylchloride, polyethylene and the like. That flat portion is provided at its acute-angled corners with buttons or the like for fastening to the belt, which in its end portions is formed with holes (not shown). At each of the obtuse-angled corners of the rhombus or rhomboid, a fixing lug 14 or 15 for connection to the handle 1 is provided. For this purpose each lug 14 or 15 has a circular hole, from which two mutually opposite, short slots extend. The handle 1 has at each end a cylindrical extension 31 or 32, and two mutually opposite noses 33, which protrude from the end of each of the extensions 31 and 32.

The handle 1 can be connected to the engaging member 2 in that the lugs 14, 15 of the engaging member 2 are bent up and the extensions 31 and 32 are fitted into the holes of the lugs so that the noses 33 pass through the short slots extending from each hole. Then the handle 1 is rotated through 90 degrees.

As is shown in FIG. 6, the engaging member 2 is provided with a hanger lug 40, which has a circular hole 41, from which a slot 42 extends. By means of the lug 40 the carrying implement together with a tire (as shown), a wheel or the like can be hung from a cap screw, hook, nail or the like fixed to a wall.

To permit the formation of the lug 40, the engaging member 2 has an aperture 43 and the lug 40 is integral with the engaging member 2 and protrudes into the aperture 43. A free space is desirably left between each of the longitudinal edges 44 of the lug 40 and the adjacent edge of the aperture 43 so that the lug 40 can be gripped and erected when this is desired.

It is also apparent from FIG. 6 that the lug 40 has an extension 45, which protrudes from the free end of the lug 40 and is much thinner than the lug 40. The extension 45 is flush with one side face, specifically the underside of the lug 40. When the lug 40 is not used, the extension 45 is placed under that edge portion 47 of the aperture 43 which is nearest to the free end of the lug 40 in such a manner that the lug 40 is deflected. In this way the lug 40 is locked in its inoperative position and will not disturb the user of the carrying implement. When the carrying implement together with a tire or the like is to be hung on a wall, the lug 40 is engaged by a finger from below and is bent out to the position for use shown in FIG. 6.

In accordance with the invention the handle 1 may be composed of two shell sections 34, 35, as is shown in FIGS. 7 to 9. The two shell sections 34, 35 are joined along a parting plane, which contains the longitudinal axis of the handle 1 or is parallel thereto. Each shell section 34, 35 may be provided on the inside with stiffening ribs, which are not shown. To permit the two shell sections to be joined to each other, one of them, e.g., the shell sectin 35, is provided in its edge face 36 with blind holes 37 and the other shell section, here 34, is provided with pins 38, which protrude from the edge face of the shell section and fit into the blind holes 37 of the shell section 35. The pins 38 may have enlarged end portions in order to increase the strength of the joint between the two shell sections 34, 35.

Each of the shell sections 34, 35 is provided at each end with a semicylindrical extension 31' or 32'.

Each of the extensions 31, 32 is constituted by two of said half cylindrical extensions. A nose 33 protrudes from the end of each extension 31' or 32' away from the parting plane.

The shell sections 34, 35 can be joined to form the handle 1 in that the pins 38 are engaged with the blind holes 37 and the two shell sections are strongly forced against each other.

The shell sections 34, 35 are preferably made by injection molding from plastic material, such as polyethylene, polyvinylchloride and the like. The two shell sections 34, 35 as well as the engaging member 2 and the belt 3 may be made at the same time in a single mold. This constitutes a desirable manufacturing technology and involves lower manufacturing costs. For instance, a substantial quantity of said parts may be made in one color, such as black, and the same quantity can then be made in another color, such as red. The implements can then be assembled from components in different colors.

The retaining belt 3 may be replaced by two resilient clips, claws or the like, which extend from each of the ends of the engaging member 2 and resiliently bear on the inside of the tire so that the latter can be carried.

What is claimed is:

1. An implement for carrying wheels and tires for motor vehicles comprising:

an engaging member, which consists of flexible material and is engageable with the tread of the tire so as to extend in the axial direction thereof, a handle, which is connected to the engaging member by lugs provided at the edges of the engaging member and extends transversely to the axis of the tire, a retaining belt, which extends from the engaging member as a continuation thereof and is adapted to extend through the central opening of the rim of the wheel, and a fastener which is secured to the engaging member and the belt and serves to retain the free end of the retaining belt, said handle being hollow and detachably connected at opposite ends to lugs of the engaging member, said engaging member having substantially the configuration of a rhombus or rhomboid, with extensions differing in length extending from acute-angled corners of said rhomboid, the longer of said extensions constitutes the retaining belt, the shorter of said extensions carries the fastener, and a fixing lug for the attachment of the handle protrudes from each of the obtuse-angled corners of the rhombus or the rhomboid.

2. An implement as set forth in claim 1, wherein one of the fixing lugs has a circular hole and the other has a slot, a screw-threaded extension adapted to have a nut screwed thereon is provided at one end of the handle and fits the circular hole, and a T-shaped extension fitting the slot is provided at the other end of the handle.

3. An implement according to claim 2, wherein the handle is hollow and the nut constitutes a closure cap.

4. An implement as set forth in claim 1, wherein the engaging member is provided with a hanger lug.

5. An implement as set forth in claim 4, wherein the engaging member has an aperture and the hanger lug is integral with the engaging member and protrudes from the edge of the aperture into the latter.

6. An implement as set forth in claim 4, wherein the hanger lug is provided at its free end with an extension, which when the hanger lug is in inoperative position is adapted to be placed under that edge portion of the aperture which is nearest to the free end of the lug, and said extension is much thinner than the hanger lug and flush with the underside thereof.

7. An implement for carrying wheels and tires for motor vehicles comprising:

an engaging member, which consists of flexible material and is engageable with the tread of the tire so as to extend in the axial direction thereof, a handle, which is connected to the engaging member by lugs provided at the edges of the engaging member and extends transversely to the axis of the tire, a retaining belt, which extends from the engaging member as a continuation thereof and is adapted to extend through the central opening of the rim of the wheel, and a fastener which is secured to the engaging member and the belt and serves to retain the free end of the retaining belt, one of the lugs having a circular hole and the other having a slot, a screw-threaded extension adapted to have a nut screwed thereon being at one end of the handle and fitting the circular hole, and a T-shaped extension fitting the slot provided at the other end of the handle.

8. An implement as set forth in claim 7, wherein said handle is hollow and is detachably connected at opposite ends to lugs of the engaging members.

9. An implement as set forth in claim 7, wherein said engaging member has substantially the configuration of a rhombus or rhomboid, extensions differing in length extend from the acute-angled corners of said rhomboid, the longer of said extensions constitutes the retaining belt, the shorter of said extensions carries the fastener, and a fixing lug for the attachment of the handle protrudes from each of the obtuse-angled corners of rhombus or rhomboid.

10. An implement for carrying wheels and tires for motor vehicles comprising:

an engaging member, which consists of flexible material and is engageable with the tread of the tire so as to extend in the axial direction thereof, a handle, which is connected to the engaging member by lugs providing at the edges of the engaging member and extends transversely to the axis of the tire, a retaining belt, which extends from the engaging member as a continuation thereof and is adapted to extend through the central opening of the rim of the wheel, and a fastener which is secured to the engaging member and the belt and serves to retain the free end of the retaining belt, the engaging member being provided with a hanger lug and having an aperture, the hanger lug being integral with the engaging member and protruding from an edge of the aperture.

11. An implement for carrying wheels and tires for motor vehicles comprising:

an engaging member, which consists of flexible material and is engageable with the tread of the tire so as to extend in the axial direction thereof, a handle, which is connected to the engaging member by lugs provided at the edges of the engaging member and extends transversely to the axis of the tire, a retaining belt, which extends from the engaging member as a continuation thereof and is adapted to extend through the central opening of the rim of the wheel, and a fastener which is secured to the engaging member and the belt and serves to retain the free end of the retaining belt, the engaging member being provided with a hanger lug and having an aperture formed therein, said hanger lug being provided at a free end thereof with an extension, which when the hanger lug is in an inoperative position is adapted to be placed under an edge portion of the aperture which is nearest to a free end of the lug, said extension being thinner than the hanger lug and flush with the underside thereof.

* * * * *

UNITED STATES PATENT AND TRADEMARK OFFICE

CERTIFICATE OF CORRECTION

PATENT NO. : 4,402,542

DATED : Sep. 6, 1983

INVENTOR(S) : Peter KREUTZER

It is certified that error appears in the above-identified patent and that said Letters Patent are hereby corrected as shown below:

On the title page after [30] Foreign Application Priority Data the 1st priority should read:

--Jun. 25, 1981 [AT] Austria ..... 2836--

Signed and Sealed this

*Twenty-second* Day of *November 1983*

[SEAL]

*Attest:*

GERALD J. MOSSINGHOFF

*Attesting Officer*

*Commissioner of Patents and Trademarks*